US009757839B2

(12) United States Patent
Wang et al.

(10) Patent No.: US 9,757,839 B2
(45) Date of Patent: Sep. 12, 2017

(54) GRINDER FOR GRINDING END FACE OF FIBER

(71) Applicant: SUNSEA TELECOMMUNICATIONS CO., LTD., Shenzhen (CN)

(72) Inventors: Qiyue Wang, Shenzhen (CN); Xinjun Chen, Shenzhen (CN); Qingqing Hu, Shenzhen (CN)

(73) Assignee: SUNSEA TELECOMMUNICATIONS CO., LTD., Shenzhen (CN)

( * ) Notice: Subject to any disclaimer, the term of this patent is extended or adjusted under 35 U.S.C. 154(b) by 0 days.

(21) Appl. No.: 15/386,647

(22) Filed: Dec. 21, 2016

(65) Prior Publication Data

US 2017/0100816 A1 Apr. 13, 2017

Related U.S. Application Data

(63) Continuation of application No. PCT/CN2014/082193, filed on Jul. 15, 2014.

(30) Foreign Application Priority Data

Jul. 2, 2014 (CN) ..... 2014 2 0363051 U

(51) Int. Cl.
*B24B 7/24* (2006.01)
*B24B 23/03* (2006.01)
(Continued)

(52) U.S. Cl.
CPC ..... *B24B 37/07* (2013.01); *B24B 37/30* (2013.01); *B24B 37/34* (2013.01)

(58) Field of Classification Search
CPC ..... B24B 7/24; B24B 323/03
(Continued)

(56) References Cited

U.S. PATENT DOCUMENTS 4,291,502 A * 9/1981 Grimsby ..... B24B 19/226 144/28.6
4,979,334 A * 12/1990 Takahashi ..... B24B 19/226 451/271
(Continued)

FOREIGN PATENT DOCUMENTS

CN 102300674 A 12/2011
CN 103372804 A 10/2013
(Continued)

*Primary Examiner* — Robert Rose
(74) *Attorney, Agent, or Firm* — Ladas & Parry LLP

(57) ABSTRACT

A grinder for grinding an end face of a fiber includes a housing, a fiber fixing module, a base, a transmission shaft, and a grinding pad. The housing includes an annular rack wheel with an internal engaging teeth. The fiber fixing module is positioned on a top of the housing. The base is positioned at a bottom of the housing and includes an eccentric connection portion. An end of the transmission shaft is connected to the connection portion. The transmission shaft is sleeved with an annular pinion having external engaging teeth engaging with the internal engaging teeth. The grinding pad is connected to another end of the transmission shaft and revolves around the rotation axis of the base and rotates around its own rotation axis together with the transmission shaft and matches an end face of a to-be-ground fiber penetrating the fiber fixing module.

20 Claims, 9 Drawing Sheets

(51) Int. Cl.
*B24B 37/07* (2012.01)
*B24B 37/30* (2012.01)
*B24B 37/34* (2012.01)

(58) Field of Classification Search
USPC ..... 451/282, 384, 390, 391, 41
See application file for complete search history.

(56) References Cited

U.S. PATENT DOCUMENTS

| | | | | |
|---|---|---|---|---|
| 9,296,081 | B2 * | 3/2016 | Wang | B24B 19/226 |
| 2003/0040263 | A1 * | 2/2003 | Minami | B24B 19/226<br>451/42 |
| 2011/0275283 | A1 * | 11/2011 | Pepin | B24B 23/03<br>451/28 |

FOREIGN PATENT DOCUMENTS

| | | | |
|---|---|---|---|
| CN | 203245720 | U | 10/2013 |
| CN | 203527225 | U | 4/2014 |
| JP | H1110505 | A | 1/1999 |

* cited by examiner

GRINDER FOR GRINDING END FACE OF FIBER

The present disclosure is a continuation application of International Patent Application No. PCT/CN2014/082193 with an international filing date of Jul. 15, 2014, designating the United States, and further claims foreign priority benefits to Chinese Patent Application No. 201420363051.6, filed with the Chinese Patent Office on Jul. 2, 2014, titled "GRINDER FOR GRINDING END FACE OF FIBER", the entire contents of which are incorporated herein by reference.

TECHNICAL FIELD

The present disclosure relates to the field of optical fiber communications, and particularly, to a grinder for grinding an end face of a fiber.

BACKGROUND

Derived from the communication technology, optical fiber communications have become an indispensable tool in current and future information and communication technology, and play an increasingly significant role in the modern telecommunication network. Just as the communication components of cable communication systems require connecting to a signal line and a signal connector, when performing the connection of fiber to the home (FTTH), the fibers in the fiber communication systems also need connecting to a fiber connector. During the connection, the end face of the fibers needs grinding so as to meet the requirements for fiber connection.

Generally, the grinding of the end face of the fibers is often carried out within a factory, and the grinding involves complex processes including grinding using 9 μm grinding paper, grinding using 1 μm grinding paper, polishing, or the like, which is time-consuming, inefficient, and cannot meet the requirements for operation at the scene. To solve the problems, Chinese Patent Publication No. CN102300674A discloses a polishing device for polishing a fiber connector, the fiber connector includes a connector housing and a ferrule, and the polishing device includes: a mounting element, which is configured to accommodate and hold the fiber connector; a polisher housing, which is configured to accommodate a polisher which includes a plate for supporting a polishing medium, the plate being connected to a planetary gear system. The mounting element is positioned on an upper cover. When the upper cover stays in a closed position, it seals up the polisher housing. The polishing device further includes a base, which is configured to support the polisher housing. A part of the rotatable knob is exposed out of the base, and the rotatable knob is engaged with the planetary gear system to drive the planetary gear system. When the upper cover stays in the closed position, the polishing medium is located in the vicinity of the fiber head extending from the end face of the ferrule of the fiber connector positioned in the mounting element. Although the grinding of the end face of the fibers can be achieved on the spot, the polishing device employs a complex planetary gear system, so it is bulky and inconvenient to carry. In addition, the polishing device can only be applicable to a few types of fiber connectors, which lead to a narrow application scope and cause much inconvenience in operation at the scene.

SUMMARY

An embodiment of the present disclosure provides a grinder for grinding an end face of a fiber. The grinder for grinding an end face of a fiber includes:

a housing including an annular rack wheel positioned on an inner surface of the housing, the annular rack wheel including an internal engaging teeth;

a fiber fixing module positioned on a top of the housing;

a base positioned at a bottom of the housing and configured to rotate relative to the housing, the base including an eccentric connection portion;

a transmission shaft, an end of the transmission shaft connected to the connection portion, the transmission shaft sleeved with an annular pinion including an external engaging teeth and configured to revolve along with a rotation axis of the base and rotate around its own rotation axis under the mutual engagement of the pinion and the rack wheel when the base is rotated; and a grinding pad connected to another end of the transmission shaft and configured to revolve along with the rotation axis of the base and rotate around its own rotation axis together with the transmission shaft and match an end face of a to-be-ground fiber penetrating the fiber fixing module.

BRIEF DESCRIPTION OF THE DRAWINGS

One or more embodiments are illustrated by way of example, and not by limitation, in the figures of the accompanying drawings, wherein elements having the same reference numeral designations represent like elements throughout. The drawings are not to scale, unless otherwise disclosed.

DETAILED DESCRIPTION

Figure 1:
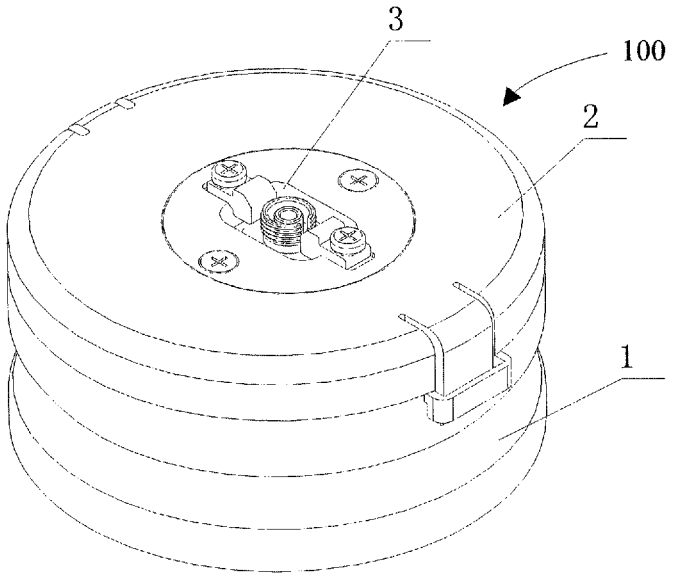
FIG. 1 is a perspective diagram illustrating a top of a grinder for grinding an end face of a fiber according to a first embodiment of the present disclosure.
Figure 2:
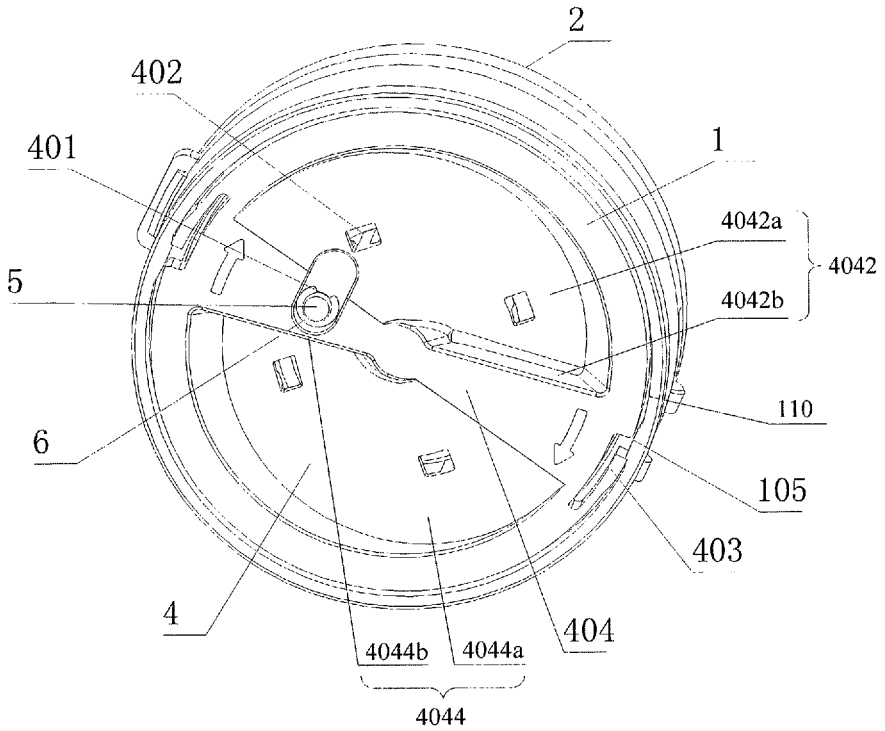
FIG. 2 is a perspective diagram illustrating a bottom of the grinder of FIG. 1.
Figure 3:
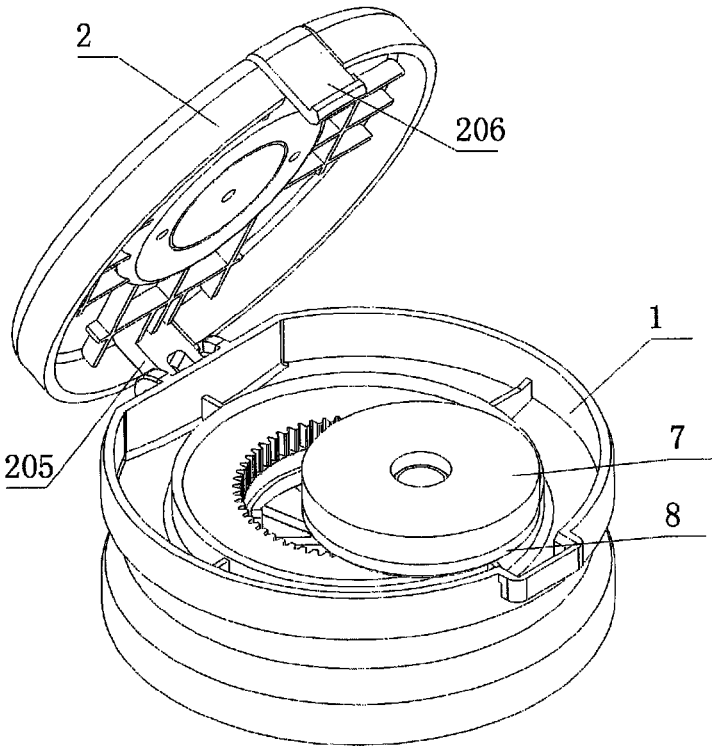
FIG. 3 is a perspective diagram illustrating the grinder of FIG. 1 with a head cover thereof unfolded.
Figure 4:
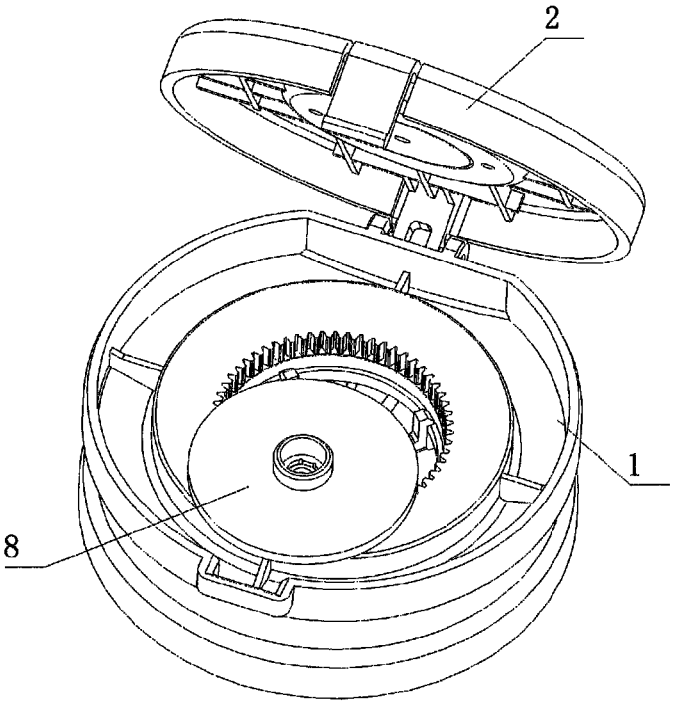
FIG. 4 is a perspective diagram illustrating the grinder of FIG. 3 with a grinding pad thereof being removed.
Figure 5:
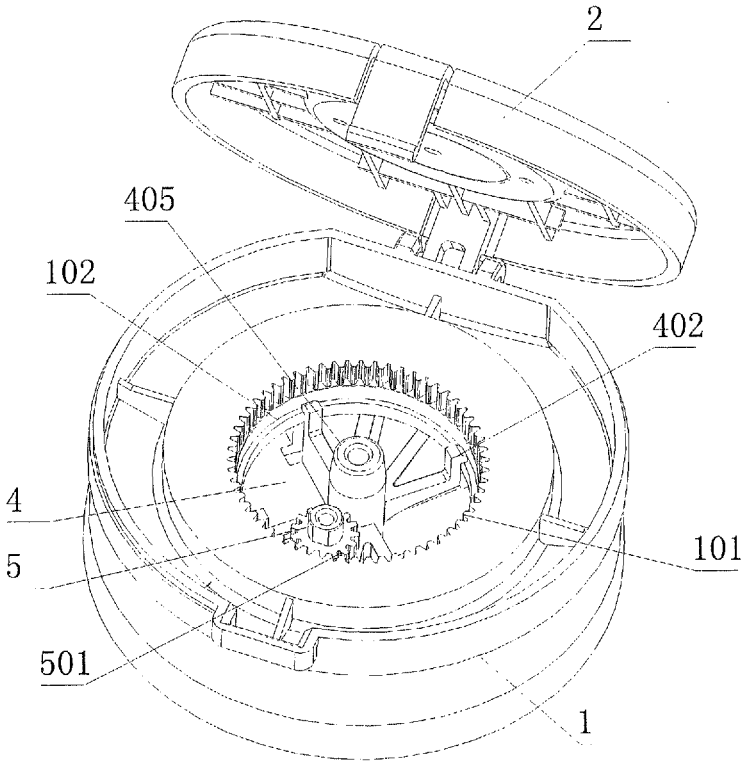
FIG. 5 is a perspective diagram illustrating the grinder of FIG. 4 with a rotary table thereof being removed.
Figure 6:
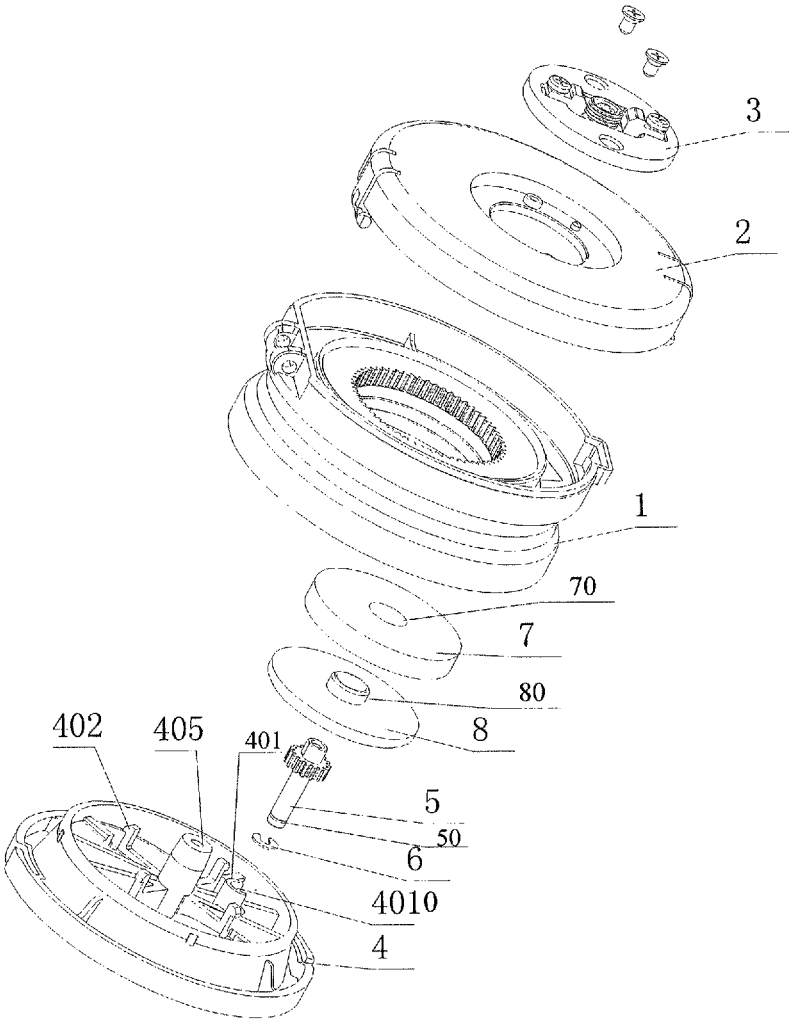
FIG. 6 is an exploded diagram of the grinder of FIG. 1.
Figure 7:
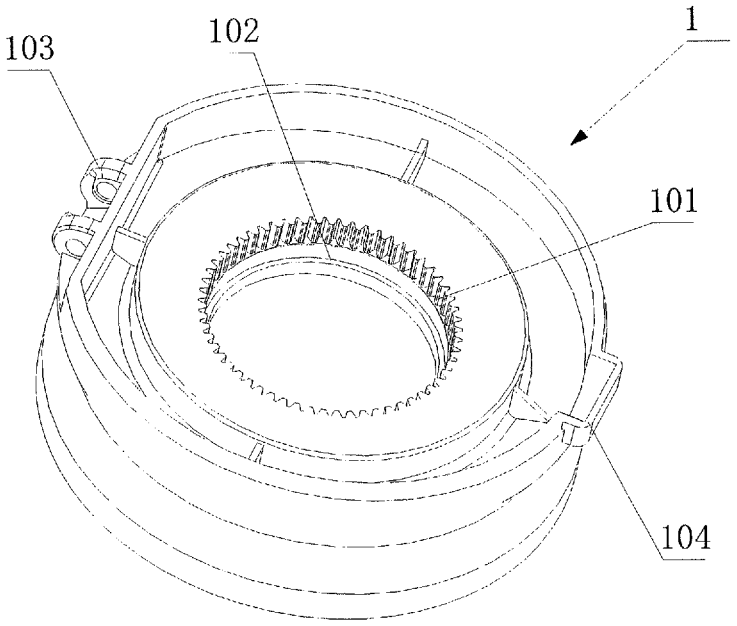
FIG. 7 is a perspective diagram illustrating a housing of the grinder of FIG. 1.
Figure 8:
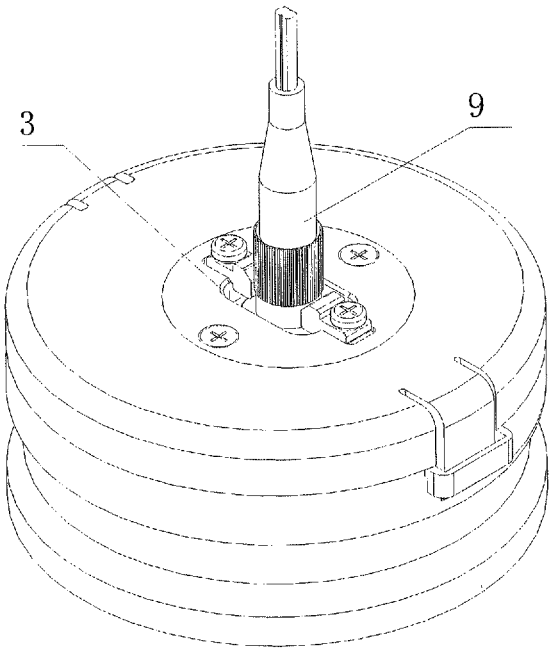
FIG. 8 is a perspective diagram illustrating a connection of the grinder of FIG. 1 and an FC-type fiber connector.
Figure 9:
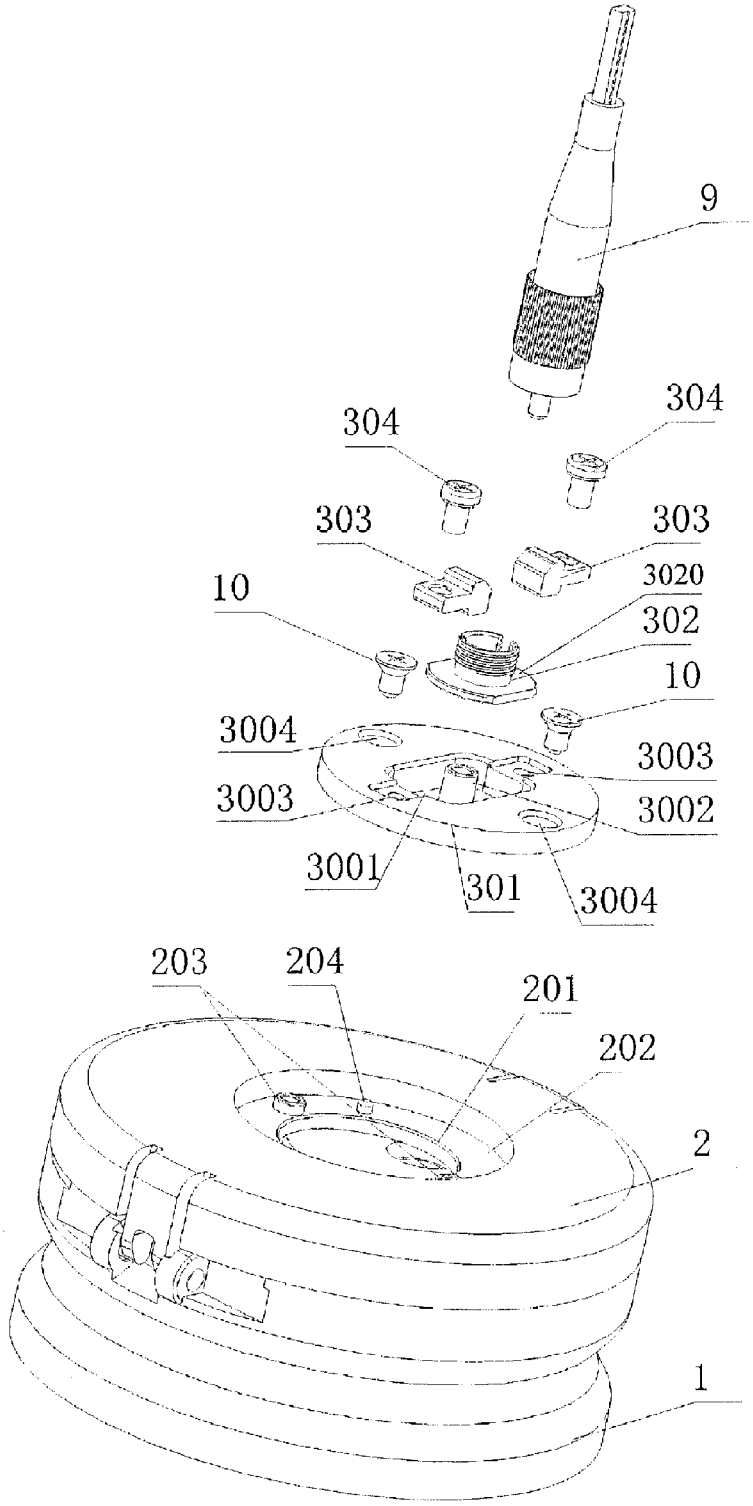
FIG. 9 is an exploded view of a fiber fixing module of the grinder of FIG. 8.
Figure 10:
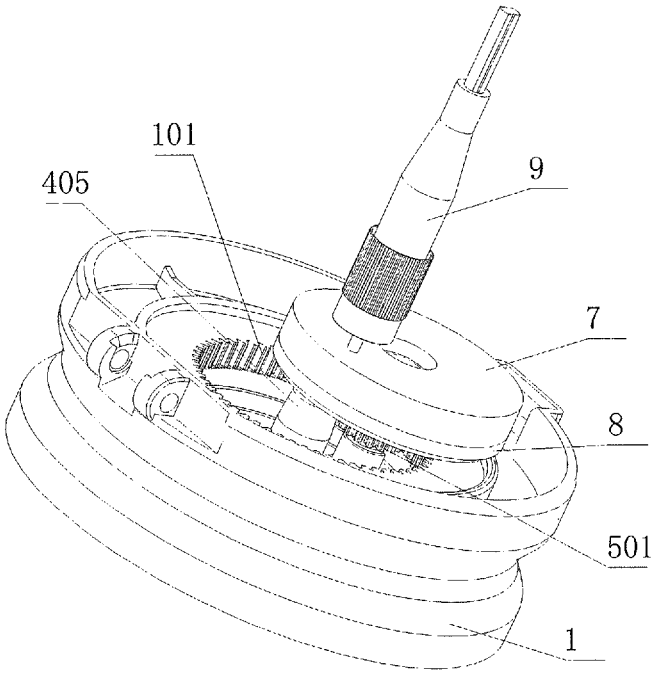
FIG. 10 is a perspective diagram illustrating a grinding pad of the grinder and the fiber connector in a working state.

Detailed description for embodiments of the present disclosure will be given below in conjunction with accompanying drawings.

FIGS. 1-10 are perspective diagrams illustrating a grinder 100 for grinding an end face of a fiber in a first embodiment of the present disclosure.

In this embodiment, a grinder 100 for grinding an end face of a fiber includes a housing 1. A fiber fixing module 3 is positioned on the top of the housing 1, and a base 4 is positioned at the bottom of the housing 1 and is configured to rotate relative to the housing 1. The base 4 includes an eccentric connection portion 401. The connection portion 401 is connected to a transmission shaft 5 which is configured to revolve along with the rotation axis of the base 4. The transmission shaft 5 is sleeved with an annular pinion 501 having external engaging teeth; an inner side of the housing 1 is provided with an annular rack wheel 101 having internal engaging teeth; the transmission shaft 5 is configured to rotate under the mutual engagement of the pinion 501 and the rack wheel 101; the transmission shaft 5 is connected to a grinding pad 7 which is configured to rotate along with the transmission shaft 5 and revolve along with the rotation axis of the base 4 together with the transmission shaft 5. When grinding, the grinding pad 7 matches an end face of a to-be-ground fiber penetrating the fiber fixing module 3.

With regard to the grinder 100 for grinding an end face of a fiber, when the base 4 of the grinder rotates, it drives the transmission shaft 5 to rotate around the rotation axis of the base 4, thus achieving the revolution of the transmission shaft 5. In the meanwhile, by means of the mutual engagement of the pinion 501 positioned on the transmission shaft 5 and the rack wheel 101 positioned on the inner side of the housing 1, while the transmission shaft 5 revolves, it also rotates around its on rotation axis. The rotation of the transmission shaft 5 drives the grinding pad 7 to revolve around the rotation axis of the base 4 and rotate around its own rotation axis, so that when the grinding pad 7 is grinding the end face of the fiber, the end face of the fiber slides on the grinding surface of the grinding pad 7 to form spiral patterns. Thus, the contact point of the end face of the fiber on the grinding surface of the grinding pad 7 is constantly changing in the grinding process, ensuring a good contact of the end face of the fiber and the grinding surface of the grinding pad 7, excellent grinding quality, and uniform ground end face. In addition, the pinion 501 and the rack wheel 101 of the grinder 100 form a first-level gear transmission enabling the grinding pad 7 to revolve around the rotation axis of the base 4 and rotate around its own rotation axis, instead of conventional complex planetary gear systems, so the grinder 100 has simple structure, small size, low cost, efficient and reliable transmission scheme, is easy to carry and more practicable for site operation.

In some exemplary embodiments, the rack wheel 101 and the housing 1 are integratedly form with each other by injection molding, or are independently formed with each other and then are assembled to form a detachable structure. In this illustrated embodiment, an integrated structure is adopted, which can greatly simplify the assembly steps, save the corresponding components required for the assembly, thus being favorable to reducing the volume of the grinder.

The housing 1 further includes a head cover 2. T head cover 2 is positioned on the top of the housing 1 and capable of opening or closing the housing 1. The fiber fixing module 3 is positioned on the head cover 2, and the fiber fixing module 3 is detachably connected to the head cover 2. Therefore, the fiber fixing module 3 can be replaced conveniently so as to adapt to different types of fiber connectors 9, thus broadening the application scope of grinding. Furthermore, both the head cover 2 and the housing 1 are openable, so it is very convenient to open the head cover 2 to replace the grinding pad 7.

In some exemplary embodiments, the fiber fixing module 3 includes a pedestal 301, and a connector joint 302 is detachably connected to the pedestal 301. When grinding, the to-be-ground fiber is inserted in a fiber connector 9, and the fiber connector 9 is inserted in the connector joint 302. So, different types of fiber connectors 9 can be connected through simply replacing the connector joint 302 to achieve the grinding of the end face of different types of fibers. As a result, the grinder 100 has broader adaptability, better universality, and much lower construction costs.

To facilitate the aforesaid detachable connection, in this embodiment, the head cover 2 is provided with a stepped hole 201 and a stepped surface 202. First connection holes 203 and positioning bulges 204 are positioned on the stepped surface 202. Third connection holes 3004 and positioning holes (not shown) are positioned on the pedestal 301. The pedestal 301 is placed on the stepped surface 202 and positioned through the engagement of the positioning bulges 204 and the positioning holes. First fastening screws 10 pass through the third connection holes 3004 and the first connection holes 203 successively to secure the pedestal 301 to the head cover 2.

The pedestal 301 includes an accommodating groove 3001, and a positioning column 3002 is positioned in the accommodating groove 3001. The positioning column 3002 includes a central hole which allows the top of the fiber connector 9 to pass through. The connector joint 302 and the positioning column 3002 are aligned, and the pedestal 301 is provided with press blocks 303 for fastening the connector joint 302. The second fastening screws 304 pass through the press blocks 303 and are inserted into the second connection holes 3003 to secure the press blocks 303 to the pedestal 301, with the press blocks 303 pressing and holding the connector joint 302 in the accommodating groove 3001.

The fiber connector 9 may be a fiber connector of FC type, SC type, APC type, or the like. In this illustrated embodiment, the fiber connector 9 is an FC type fiber connector. The connector joint 302 includes a hollow cylindrical body having external screw threads. The bottom of the cylindrical body extends outwards to form a limit edge 3020 corresponding to the accommodating groove 3001 in shape and position. To grind the end face of the fiber in the FC type fiber connector, the core head of the fiber connector 9 is inserted in and cooperates with the central hole of the positioning column 3002, so that the fiber connector 9 and the connector joint 302 form a threaded connection, and the press blocks 303 are pressed on the limit edge 3020, thus ensuring the fiber connector 9 is stably fixed on the fiber fixing module 3 to achieve the stable grinding.

In this illustrated embodiment, a rotary table 8 is positioned between one end of the transmission shaft 5 and the grinding pad 7. The transmission shaft 5, the pinion 501, and the rotary table 8 can be integratedly or independently formed with each other. In this illustrated embodiment, the transmission shaft 5, the pinion 501, and the rotary table 8 form a detachable structure, and each of the three parts is small, exquisite, and easy to process. One end face of the transmission shaft 5 includes a first flat structure, and the inner hole of the rotary table 8 is provided with a second flat structure corresponding to the first flat structure. Through the engagement of the first flat structure and the second flat structure, the rotary table 8 and the transmission shaft 5 are connected and the motion is transmitted therebetween. Furthermore, locking screws are used to fasten the rotary table 8 and the transmission shaft 5 to ensure the reliable connection. The rotary table 8 includes an extension sleeve 80, the grinding pad 7 includes a location hole 70, the extension sleeve 80 inserts in and engages with the location hole 70, thus, the rotary table 8 can drive the grinding pad 7 to rotate together with the rotary table 8. As a result, through the intermediate transmission of the rotary table 8, the motion of the transmission shaft 5 is directly transferred to the grinding pad 7 for grinding. The interference fit between the extension sleeve 80 and the location hole 70 ensures the stable installation of the grinding pad 7, and no special flat structure is involved, which facilitates the on-site replacement, thus reducing the limitations on the use.

The connection portion 401 defines a through hole 4010, and the other end of the transmission shaft 5 is extended out of the through hole 401. The extension section of the transmission shaft 5 includes a limit structure 6 which is positioned the outside of the base 4 and butts against an outer surface of the base 4, an inner surface of the base 4 is provided with a limit column 405 protruding upwards, and the limit column 405 butts against the bottom surface of the rotary table 8. The limit structure 6 can limit the position of the extension section of the transmission shaft 5, thus preventing the transmission shaft 5 from sliding into the inner sides of the housing 1 and the base 4 due to the gravity when the grinder 100 is being operated. The limit column 405 limits the position of the rotary table 8, thus preventing the transmission shaft 5 from sliding outward, so that two ends of the transmission shaft 5 are limited and fixed, thus ensuring the engagement of the rack wheel 101 and the pinion 101, which is conducive to the continuous and reliable motion transmission. The extension section of the transmission shaft 5 includes a circular groove 50, a snap spring 6 is positioned in the circular groove 50, and the snap spring 6 is positioned the outside of the base 4 and butts against the outer surface of the base 4; or the extension section of the transmission shaft 5 includes an elastic reverse buckle, and the reverse buckle butts against the outer surface of the base 4. In the illustrated embodiment, the extension section of the transmission shaft 5 includes a circular groove 50, a snap spring 6 is positioned in the circular groove 50, and the snap spring 6 butts against the outer surface of the base 4. Such a structure is simple and easy to disassemble.

A plurality of elastic suspension arms 403 having the same extension direction are positioned along the periphery of the base 4; a plurality of arc bumps 105 are positioned on an inner surface 110 of the housing 1; when the base 4 rotates to drive the elastic suspension arms 403 to the corresponding arc bumps 105, the arc bumps 105 squeeze the corresponding suspension arms 403 to bend inwards; when free ends of the elastic suspension arms 403 slide from one end of the arc bumps 105 to another end thereof, the bended elastic suspension arms 403 squeezed by the arc bumps 105 are released and impact the inner surface 110 of the housing 1 to generate a sound. Based on the sound, the rotation circles can be recorded and the grinding degree is calculated, which is favorable to acquiring uniform ground end face of fibers. The elastic suspension arms 403 and the arc bumps 105 form a ratchet tooth structure something like a ratchet wheel, which can prevent the base 4 from rotating reversely. The grinding tool is easy to operate for any user, and when in use, the operation method is easy to be grasped, so that the damage of the grinding tool caused by different rotation directions can be effectively avoided on the construction site, thus protecting the internal transmission system.

To facilitate the operation, an unidirectional handle 404 is positioned on the outer surface of the base 4, and a plurality of buckles 402 are positioned on the inner surface of the base 4 and surround the limit column 405; an annular step 102 is positioned below the rack wheel 101 on the inner side of the housing 1; the buckles 402 and the annular step 102 are buckled up; when the handle 404 is driven to rotate the base 4, the buckles 402 slide on the annular step 102. The base 4 includes a first pushing portion 4042 and a second pushing portion 4044. The first pushing portion 4042 includes a first half-spiral cambered surface 4042*a* and a first vertical plane 4042*b* connected to the first half-spiral cambered surface 4042*a*; the second pushing portion 4044 includes a second half-spiral cambered surface 4044*a* and a second vertical plane 4044*b* connected to the second half-spiral cambered surface 4044*a*. The first pushing portion 4042 and the second pushing portion 4044 are positioned on two opposite sides of the handle 404. The design conforms to the human engineering principle. In general, when the hand of a user holds the handle 404, the thumb and forefinger of the user can be twisted to form an S shape and the two fingers respectively exert on the first pushing portion 4042 and the second pushing portion 4044 to push the base 4 to rotate, thus supplying the motive power for the grinder 100.

A first connection arm 103 is positioned on one side of the housing 1, and a clamping buckle 104 is positioned on another side of the housing 1 and is opposite to the first connection arm 103; a second connection arm 205 is positioned on one side of the head cover 2, and an extension arm 206 is positioned on another side of the head cover 2 and is opposite to the extension arm 206; the first connection arm 103 and the second connection arm 205 are rotatably connected via a hinge pin, and the extension arm 206 is capable of being inserted into the clamping buckle 104. The second connection arm 205 is provided with a limit part, which may be a bump or buckle or the like. When the head cover 2 is unfolded, the limit part can limit the opening angle of the head cover 2 thus ensuring the stability of the connection.

Figure 11:
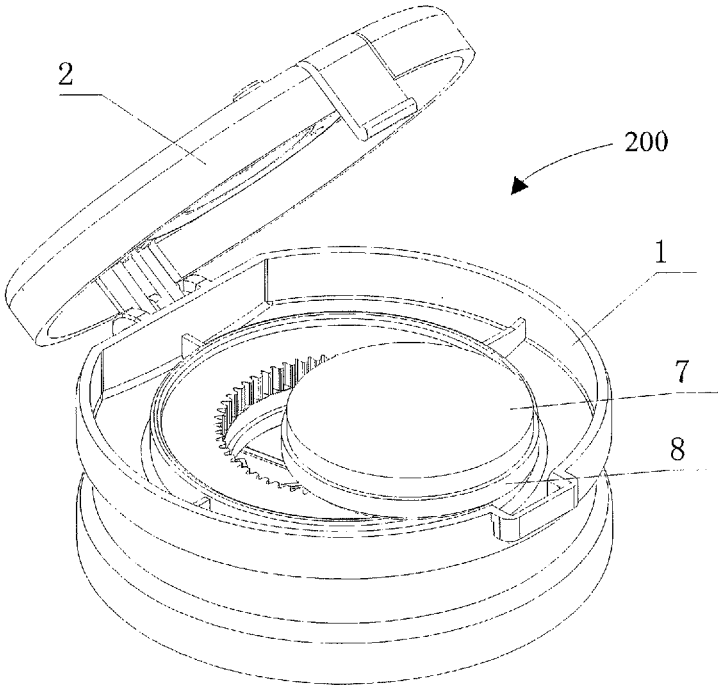
FIG. 11 is a perspective diagram illustrating a grinder for grinding an end face of a fiber according to a second embodiment of the present disclosure.
Figure 12:
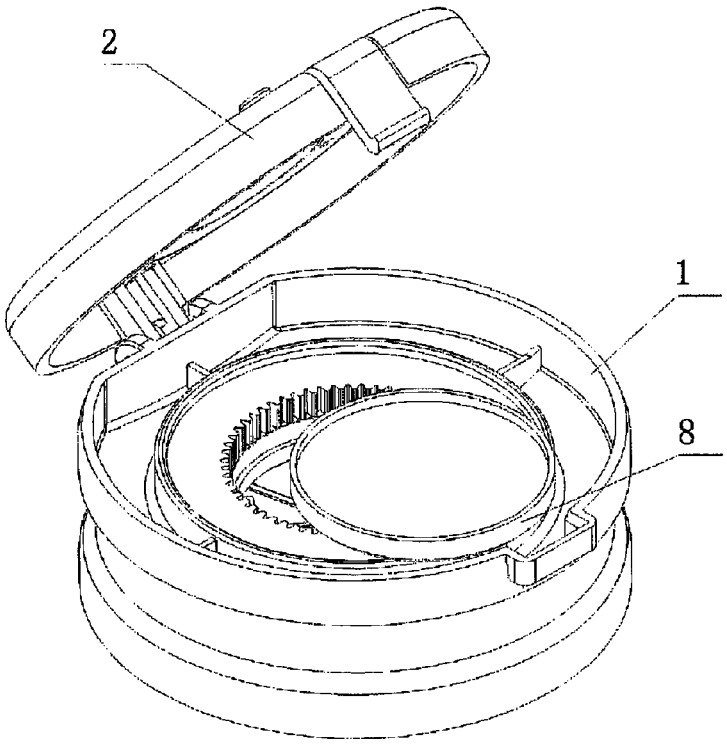
FIG. 12 is a perspective diagram illustrating the grinder of FIG. 11 with a grinding pad thereof being removed.
Figure 13:
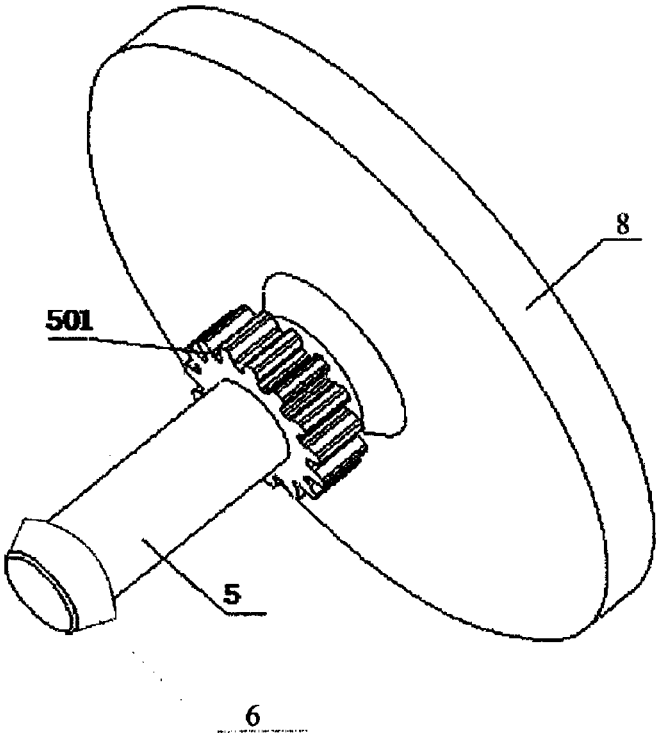
FIG. 13 is a perspective diagram illustrating a connection of a rotary table, a pinion, and a transmission shaft of the grinder of FIG. 11.

FIGS. 11-13 are perspective diagrams illustrating a grinder 200 for grinding an end face of a fiber in a second embodiment of the present disclosure.

The grinder 200 for grinding an end face of a fiber of the second embodiment is essentially the same as the grinder 100 in the first embodiment as shown in FIGS. 1-10, except that:

The transmission shaft 5, the pinion 501, and the rotary table 8 are integratedly formed with each other by injection molding, which saves the number of the parts and facilitates the assembly. In addition, in this embodiment, the limit structure 6 is an elastic reverse buckle 6, and the reverse buckle 6 butts against the outer surface of the base 4. The reverse buckle 6 is integratedly formed with the transmission shaft 5.

Figure 14:
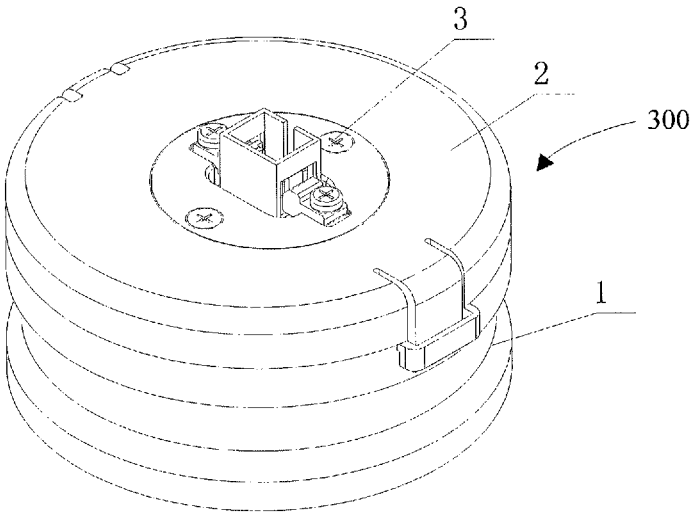
FIG. 14 is a perspective diagram illustrating a grinder for grinding an end face of a fiber according to a third embodiment of the present disclosure.
Figure 15:
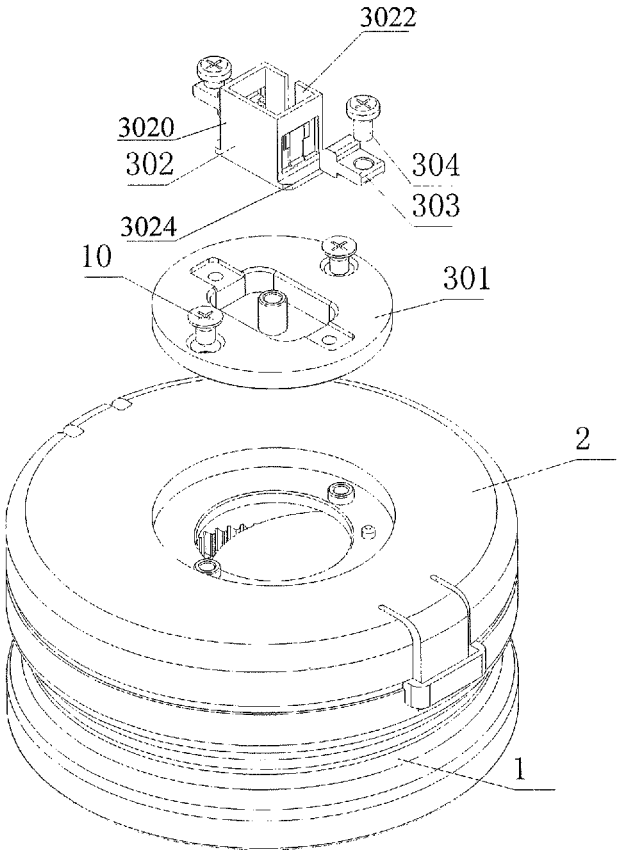
FIG. 15 is an exploded view of a fiber fixing module of the grinder of FIG. 14.

FIGS. 14-15 are perspective diagrams illustrating a grinder 300 for grinding an end face of a fiber in a third embodiment of the present disclosure.

The grinder 300 for grinding an end face of a fiber of the third embodiment is essentially the same as the grinder 100 in first embodiment as shown in FIGS. 1-10, except that:

The fiber connector 9 is an SC type connector. The connector joint 302 includes a hollow square body 3020 including clamping pieces 3022 positioned on opposite sides, and the bottoms of the other two opposite sides of the square body 3020 extend outwards to form two limit lugs 3024. To grind the end face of the fiber in the SC type fiber connector, the core head of the fiber connector 9 is inserted in and cooperates with the central hole of the positioning column 3002, the press blocks 303 squeeze the clamping pieces 3022 at two opposite sides of the connector joint 302, the clamping pieces 3022 squeeze the fiber connector 9, and the press blocks 303 press the limit lugs 3024 to the pedestal 301, thus achieving the connection and assembly of the connector joint 302 to the pedestal 301.

The grinder 100, 200, 300 of the present disclosure is suitable for operation at scene, and the fiber fixing module 3 can be replaced conveniently to adapt to different types of fiber connectors. The grinder 100, 200, 300 has few parts, small size, friendly operation, low accumulated error, high reliability, low costs, and beautiful physical appearance.

Finally it shall be noted that, the above embodiments are only used to describe but not to limit the technical solutions of the present disclosure; and within the concept of the present disclosure, technical features of the above embodiments or different embodiments may also be combined with each other, the steps may be implemented in an arbitrary order, and many other variations in different aspects of the present disclosure described above are possible although, for purpose of simplicity, they are not provided in the details. Although the present disclosure has been detailed with reference to the above embodiments, those of ordinary skill in the art shall appreciate that modifications can still be made to the technical solutions disclosed in the above embodiments or equivalent substations may be made to some of the technical features, and the corresponding technical solutions will not depart from the scope of the present disclosure due to such modifications or substations.

What is claimed is:

1. A grinder for grinding an end face of a fiber, comprising:

a housing comprising an annular rack wheel positioned on an inner surface of the housing, the annular rack wheel comprising an internal engaging teeth;

a fiber fixing module positioned on a top of the housing, the fiber fixing module comprising a pedestal and a connector joint detachably connected to the pedestal; when grinding, the to-be-around fiber is inserted in a fiber connector, and the fiber connector is inserted in the connector joint;

a base positioned at a bottom of the housing and configured to rotate relative to the housing, the base comprising an eccentric connection portion;

a transmission shaft, an end of the transmission shaft connected to the connection portion, the transmission shaft sleeved with an annular pinion comprising an external engaging teeth and configured to revolve along with a rotation axis of the base and rotate around its own rotation axis under the mutual engagement of the pinion and the rack wheel when the base is rotated; and a grinding pad connected to another end of the transmission shaft and configured to revolve along with the rotation axis of the base and rotate around its own rotation axis together with the transmission shaft and match an end face of a to-be-ground fiber penetrating the fiber fixing module.

2. The grinder according to claim 1, wherein the housing comprises a head cover positioned on the top of the housing and capable of opening or covering the housing; the fiber fixing module is detachably connected to the head cover.

3. The grinder according to claim 2, wherein the housing comprises a first connection arm and a clamping buckle, the first connection arm is positioned on one side of the housing, and the clamping buckle is positioned on another side of the housing and opposite to the first connection arm; the head cover comprises a second connection arm and an extension arm, the second connection arm is positioned on one side of the head cover, and the extension arm is positioned on another side of the head cover and opposite to the second connection arm; the first connection arm and the second connection arm are rotatably connected to each other, and the extension arm is capable of being inserted into the clamping buckle.

4. The grinder according to claim 1, wherein the pedestal comprises a positioning column and defines an accommodating groove, the positioning column is positioned in the accommodating groove and defines a central hole allowing a top of the fiber connector to pass through, the connector joint and the positioning column are aligned with other, the pedestal comprises a plurality of press blocks, and the press blocks are positioned on the pedestal and press the connector joint in the accommodating groove.

5. The grinder according to claim 4, wherein the connector joint comprises a hollow cylindrical body, a bottom of the cylindrical body extends outwards to form a limit edge, and the press blocks press the limit edge in the accommodating groove.

6. The grinder according to claim 4, wherein the connector joint comprises a hollow square body, the hollow square body comprises clamping pieces positioned on opposite sides, bottoms of the other two opposite sides of the hollow square body each extend outwards to form two limit lugs, and the press blocks press the limit lugs in the accommodating groove.

7. The grinder according to claim 1, further comprising a rotary table positioned between one end of the transmission shaft and the grinding pad.

8. The grinder according to claim 7, wherein the connection portion defines a through hole, an end of the transmission shaft extends out of the through hole, the transmission shaft comprises a limit structure at the end of the transmission shaft extending out of the through hole, the limit structure is positioned outside the base and the housing and butts against an outer surface of the base, the base comprises a limit column protruding from an inner surface of the base, and the limit column butts against a surface of the rotary table.

9. The grinder according to claim 8, wherein the limit structure is a snap spring, the transmission shaft defines a circular groove at the end of the transmission shaft extending out of the through hole, and the snap spring is positioned in the circular groove and surrounds the transmission shaft and butts against the outer surface of the base.

10. The grinder according to claim 8, wherein the limit structure is an elastic reverse buckle positioned at the end of the transmission shaft extending out of the through hole, and the reverse buckle butts against the outer surface of the base.

11. The grinder according to claim 1, wherein the base comprises a plurality of elastic suspension arms having a same extension direction, the elastic suspension arms are positioned along a periphery of the base; the housing comprises a plurality of arc bumps positioned on an inner surface of the housing; when the base rotates to drive the elastic suspension arms to the arc bumps, the arc bumps squeeze the suspension arms to bend inwards; when free ends of the elastic suspension arms slide off the arc bumps, the bended elastic suspension arms squeezed by the arc bumps are released and impact the inner surface of the housing to generate a sound.

12. The grinder according to claim 1, wherein the base comprises a handle, and the handle is positioned on an outer surface of the base.

13. The grinder according to claim 12, wherein the base comprises a first pushing portion and a second pushing portion; the first pushing portion comprises a first half-spiral cambered surface and a first vertical plane connected to the first half-spiral cambered surface; the second pushing portion comprises a second half-spiral cambered surface and a second vertical plane connected to the second half-spiral cambered surface; the first pushing portion and the second pushing portion are positioned on two opposite sides of the handle.

14. The grinder according to claim 1, wherein the base comprises a plurality of buckles annularly positioned on an inner surface of the base; the housing comprises an annular step positioned on an inner surface of the housing; the buckles and the annular step are buckled up; when the base rotates, the buckles slide on the annular step.

15. A grinder for grinding an end face of a fiber, comprising:

a housing comprising an annular rack wheel positioned on an Inner surface of the housing, the annular rack wheel comprising an internal engaging teeth;

a fiber fixing module positioned on a top of the housing;

a base positioned at a bottom of the housing and configured to rotate relative to the housing, the base comprising an eccentric connection portion;

a transmission shaft, an end of the transmission shaft connected to the connection portion, the transmission shaft sleeved with an annular pinion comprising an external engaging teeth and configured to revolve along with a rotation axis of the base and rotate around its own rotation axis under the mutual engagement of the pinion and the rack wheel when the base is rotated; and a grinding pad connected to another end of the transmission shaft and configured to revolve along with the rotation axis of the base and rotate around its own rotation axis together with the transmission shaft and match an end face of a to-be-ground fiber penetrating the fiber fixing module.

16. The grinder according to claim 15, further comprising a rotary table positioned between one end of the transmission shaft and the grinding pad.

17. The grinder according to claim 16, wherein the connection portion defines a through hole, an end of the transmission shaft extends out of the through hole, the transmission shaft comprises a limit structure at the end of the transmission shaft extending out of the through hole, the limit structure is positioned outside the base and the housing and butts against an outer surface of the base, the base comprises a limit column protruding from an Inner surface of the base, and the limit column butts against a surface of the rotary table.

18. The grinder according to claim 17, wherein the limit structure is a snap spring, the transmission shaft defines a circular groove at the end of the transmission shaft extending out of the through hole, and the snap spring is positioned in the circular groove and surrounds the transmission shaft and butts against the outer surface of the base.

19. The grinder according to claim 17, wherein the limit structure is an elastic reverse buckle positioned at the end of the transmission shaft extending out of the through hole, and the reverse buckle butts against the outer surface of the base.

20. A grinder for grinding an end face of a fiber, comprising:

a housing comprising an annular rack wheel positioned on an inner surface of the housing, the annular rack wheel comprising an internal engaging teeth;

a fiber fixing module positioned on a top of the housing;

a base positioned at a bottom of the housing and configured to rotate relative to the housing, the base comprising an eccentric connection portion;

a transmission shaft, an end of the transmission shaft connected to the connection portion, the transmission shaft sleeved with an annular pinion comprising an external engaging teeth and configured to revolve along with a rotation axis of the base and rotate around its own rotation axis under the mutual engagement of the pinion and the rack wheel when the base is rotated; and a grinding pad connected to another end of the transmission shaft and configured to revolve along with the rotation axis of the base and rotate around its own rotation axis together with the transmission shaft and match an end face of a to-be-ground fiber penetrating the fiber fixing module;

wherein the base comprises a plurality of elastic suspension arms having a same extension direction, the elastic suspension arms are positioned along a periphery of the base; the housing comprises a plurality of arc bumps positioned on an inner surface of the housing; when the base rotates to drive the elastic suspension arms to the arc bumps, the arc bumps squeeze the suspension arms to bend inwards; when free ends of the elastic suspension arms slide off the arc bumps, the bended elastic suspension arms squeezed by the arc bumps are released and impact the inner surface of the housing to generate a sound.

* * * * *